United States Patent [19]

Hitchcock

[11] Patent Number: 4,683,404

[45] Date of Patent: Jul. 28, 1987

[54] STARTING CIRCUIT AND APPARATUS FOR HIGH PRESSURE SODIUM LAMPS

[75] Inventor: William H. Hitchcock, Vicksburg, Miss.

[73] Assignee: Cooper Industries, Houston, Tex.

[21] Appl. No.: 912,037

[22] Filed: Sep. 29, 1986

[51] Int. Cl.[4] ..... H05B 37/00

[52] U.S. Cl. ..... 315/289; 315/177; 315/242; 315/244; 315/276

[58] Field of Search ..... 315/289, 177, 276, 244, 315/242

[56] References Cited

U.S. PATENT DOCUMENTS

| | | | |
|---|---|---|---|
| 3,522,475 | 8/1970 | Hashimoto | 315/289 |
| 3,963,958 | 6/1976 | Nuckolls | 315/289 |
| 4,072,878 | 2/1978 | Engel et al. | 315/289 |
| 4,415,837 | 11/1983 | Sodini | 315/289 |
| 4,461,982 | 7/1984 | Fahnrich | 315/289 |

*Primary Examiner*—Harold Dixon

*Attorney, Agent, or Firm*—E. E. Scott; R. L. Maxwell

[57] ABSTRACT

A lighting apparatus which provides high voltage pulses for starting a high pressure sodium lamp. The apparatus includes two capacitors, two blocking diodes, a voltage sensitive symmetrical switch, and multiple resistances across which pulses are distributed. The aforementioned elements are electrically connected together and with a tapped ballast reactor so that one of the capacitors charges through an impedance in the negative half-cycle, and thereafter, when line voltage goes positive, the other capacitor charges through an impedance equal to the sum of the multiple resistances. When the voltage of the capacitors reaches a predetermined voltage exceeding the breakdown voltage of the voltage sensitive symmetrical switch, the capacitors discharge. This discharge, because of an autotransformer relationship within the reactor, produces a high voltage pulse of predetermined height and width once per each cycle of the source voltage.

4 Claims, 1 Drawing Figure

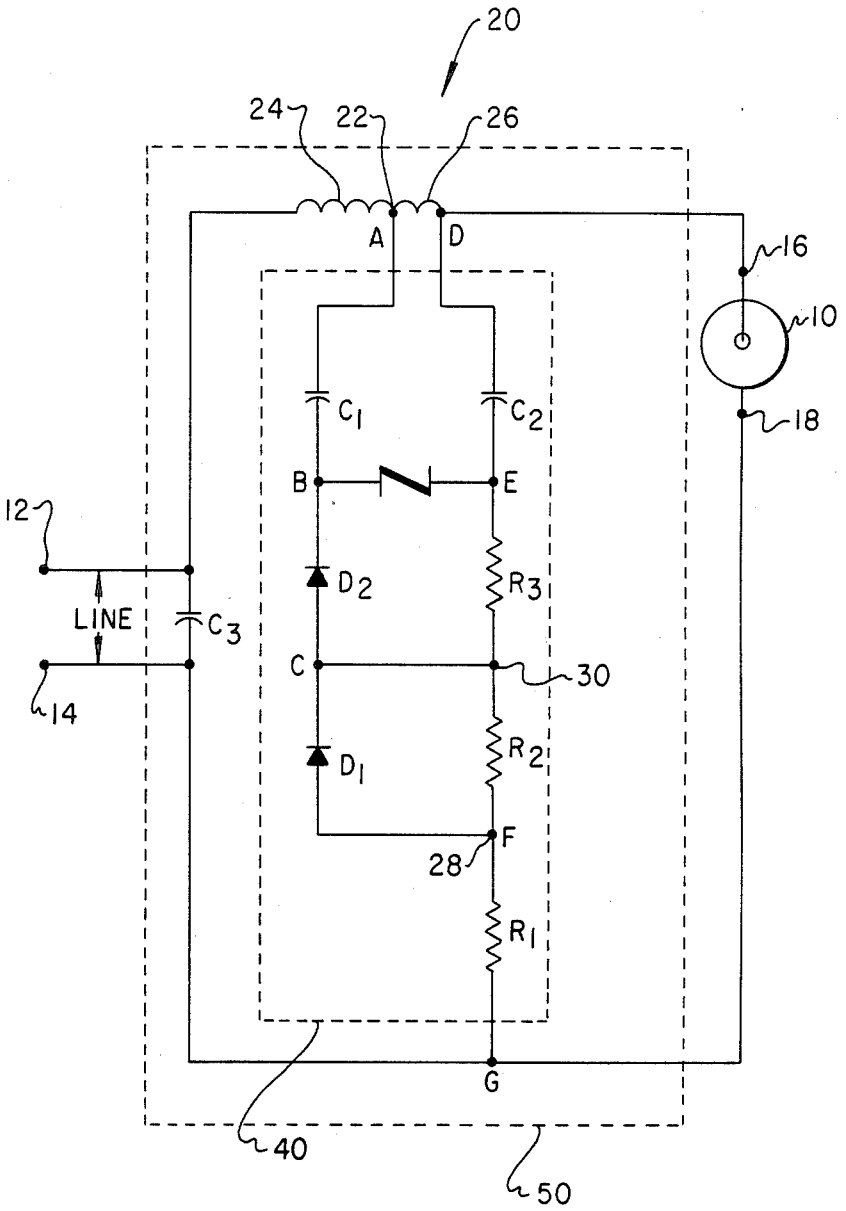
20
24
22
26
A
D
16
10
18
C1
C2
B
E
12
D2
R3
LINE
C3
C
30
14
D1
R2
F
28
R1
G
40
50

STARTING CIRCUIT AND APPARATUS FOR HIGH PRESSURE SODIUM LAMPS

BACKGROUND OF THE INVENTION

1. Field of the Invention

This invention relates generally to gaseous discharge lamps and, more particularly, to a circuit and apparatus which provide high voltage pulses for starting high pressure sodium discharge lamps.

2. Description of the Prior Art

Starting circuits and apparatus for high pressure sodium lamps are well known in the art. Examples of such circuits and apparatus are disclosed in U.S. Pat. Nos. 4,322,660 to Johnson, 4,143,304 to Hitchcock, and 4,072,878 to Engel, et al.

The Johnson patent discloses an apparatus for providing high voltage pulses for starting a high pressure sodium discharge lamp, said apparatus having a single capacitor in series with a blocking diode and a charging resistor. When the voltage of the capacitor reaches a predetermined voltage exceeding the zener voltage of a parallel zener diode, the capacitor discharges through a ballast which is connected in autotransformer relationship therewith to provide the high voltage pulse to start the lamp.

The Hitchcock patent discloses an apparatus using a voltage amplification circuit the output of which is applied across a ballast reactor which is connected thereto in autotransformer relationship.

The Engel, et al. patent discloses an apparatus that provides for high voltage pulses for starting a sodium discharge lamp by using the breakdown characteristics of a zener diode to provide timed starting pulses.

SUMMARY OF THE INVENTION

The starting circuit of the present invention provides a circuit featuring better stability of firing angle than the known and generally used starting circuits. Improved stability of firing angle is achieved through use of RC charging values which lag source voltage by amounts such that firing angle is fairly independent of source voltage variation. Further, the starting circuit of the present invention uses more economical components than many prior art starting circuits by having multiple resistances across which pulses are distributed. Voltages across individual resistances and rectifiers in the preferred embodiment of the present invention are kept under 1,000 volts.

Accordingly, it is an object of the present invention to provide an improved starting circuit for gaseous discharge lamps which require high starting voltages.

Another object of the present invention is to provide a simple and reliable starting circuit for discharge lamps of the above described type.

Yet another object of the present invention is to provide an economical starting circuit for discharge lamps of the above described type.

Other objects, advantages, and new features of the invention will become apparent from the following detailed description of the invention when considered in conjunction with the accompanying drawing.

BRIEF DESCRIPTION OF THE DRAWING

The sole FIGURE in the accompanying drawing is a circuit diagram of the preferred embodiment of the present invention.

DESCRIPTION OF THE PREFERRED EMBODIMENT

In the sole FIGURE is shown a circuit according to the present invention for connection across an AC source for starting a high pressure sodium lamp 10. Certain nodes (i.e., points of connection between two or more circuit elements) are designated by letters (e.g., "A") to facilitate description of the circuit. The circuit comprises input terminals 12, 14 operable to be connected across the AC source and output terminals 16, 18 operable to have the lamp 10 connected thereacross.

A ballast reactor 20 has a tap 22 intermediate the ends thereof which defines first and second winding portions, said first winding portion 24 having a greater length than said second winding portion 26, and having a transformation ratio therebetween substantially greater than unity. The ballast reactor 20 is connected at its ends in series between input terminal 12 and output terminal 16, with the second winding portion 26 connected to output terminal 16. Input terminal 14 electrically connects to output terminal 18.

A capacitive energy storage means and blocking diode means therefor are connected across the second winding portion 26 of the ballast reactor 20 and are in circuit with output terminal 18. The capacitive energy storage means comprises two individual capacitors: a first, C1, which is in circuit between the tap 22 (also designated "node A") and a common electrical point 28 (also designated "node F"); and a second, C2, which is in circuit between output terminal 16 (connecting at node D) and common electrical point 28. A charging resistor means R1 between the common electrical point 28 and output terminal 18 (connecting at node G). The aforementioned blocking diode means comprises two diodes: a first, D1, having its anode connected to common electrical point 28 and its cathode connected in circuit with tap 22; and a second, D2, having its anode connected in circuit with common electrical point 28 and its cathode connected in circuit with tap 22.

Resistor means comprising two individual resistors R3, R2 in series, is connected in circuit between output terminal 16 and output terminal 18, intermediate common point 28 and capacitor C2. A point intermediate the two resistors, point 30, electrically connects to a point intermediate diodes D1 and diode D2, making it part of designated "node C".

A bilateral symmetrical voltage sensitive switch such as a sidac, Q1, is connected across the second winding 26 with one terminal connected intermediate capacitor C1 and diode D2 (at node B) and the other terminal connected intermediate capacitors C2 and the resistors R2, R3 (at node E).

In the operation of the circuit as shown in the FIGURE, during negative half-cycle the potential of node D is negative with respect to node G, capacitor C1 charges through impedance R1, and diodes D1 and D2 are forward biased. Diode blocking will be performed by Q1 and D2 when the voltage C1 exceeds the input voltage.

During the initial part of the positive half-cycle, potential of node D is positive with respect to node G and capacitor C2 charges through an impedance equal to the sum of resistances R1, R2, and R3.

Firing or pulse generation occurs when the voltage of capacitor C1 and C2 total the breakdown voltage of switch Q1, a typical value of which would be 240 volts. Such a pulse is generated as discharge current of the capacitor C1, C2 induces a voltage across ballast inductor 20. Because of the auto transformer relationship within the reactor, induced current within a small portion of the reactor produces a high voltage pulse of predetermined height and width once per each cycle of the source voltage. Load impedance of the pulse generated by the above described circuit equals the sum of resistances R1, R2, and R3.

It should be noted that in the above description line source impedance has been assumed to be zero with regard to transfer of high frequency pulse to lamp 10. An additional capacitor could be used across the line to assure such a transfer.

By way of example only, a circuit such as shown in the FIGURE could be constructed of components having designations or values as listed below.

Q1: K2400F23 Sidac, 240 $V_{BO}$
D2: 1N4007 Rectifier, 1 amp 1000 v PIV
D1: 1N4007 Rectifier, 1 amp 1000 v PIV
C2: 0.22 mfd 200 v
C1: 0.33 mfd 200 V
R3: 2700 ohms, 1 watt
R2: 2700 ohms, 1 watt
R1: 4300 ohms, 1 watt It should be appreciated that the above described circuit could conventionally be constructed in the form of an apparatus. Various groupings of shown elements could be incorporated into such apparatus. Two possible groupings of elements are shown in the FIGURE. The two groupings are enclosed within dashed lines 40 and 50 which define, respectively, two possible apparatus.

Obviously, numerous modifications and variations of the present invention are possible in light of the above teachings. It is therefore to be understood that, within the scope of the appended claims, the present invention may be practiced otherwise than as specifically described hereinabove.

I claim:

1. A circuit for incorporation into a starting apparatus for a high pressure sodium discharge lamp, said circuit comprising a six-node (A, B, C, D, E, F, G) electrical network including a first capacitor having a known capacitance C1 connected between network nodes (A) and (B); a second capacitor having a known capacitance C2 connected between network nodes (D) and (E); a first, second, and third resistors having known resistances R1, R2, R3 connected between network nodes (E) and (C), (C) and (F), and (F) and (G), respectively; first and second diodes D1, D2 connected between network nodes (B) and (C), and (C) and (F), respectively; and a bilateral symmetrical voltage sensitive switch connected between network nodes (B) and (E).

2. A starting apparatus for connection across an AC source for starting a high pressure sodium discharge lamp, said apparatus comprising:

input terminals operable to be connected across said AC source, output terminals operable to have said discharge lamp connected thereacross, a ballast reactor having a tap intermediate the ends thereof to define first and second winding portions, said first winding portion having a greater length than said second winding portion and having a transformation ratio therebetween substantially greater than unity, said ballast reactor connected at its ends in series between one of said input terminals and one of said output terminals with said second winding portion connected to said one output terminal, and the other of said input terminals electrically connected to the other of said output terminals;

capacitive energy storage means and blocking diode means therefore connected across said second winding portion of said ballast reactor, and also in circuit with said other output terminal, said capacitive energy storage means comprising two individual capacitors a first of which is in circuit between said tap and a common electrical point and the second of which is in circuit between said one output terminal and said common electrical point, a charging resistor means connected between said common electrical point and said other output terminal, and said blocking diode means comprising two individual diodes a first of which having its anode connected to said common electrical point and having its cathode connected in circuit with said tap and the second of which having its anode connected in circuit with said common electrical point and having its cathode connected in circuit with said tap;

resistor means comprising two individual resistors in series connected in circuit between said first output terminal and said second output terminal intermediate said common point and said second capacitor with a point intermediate the two resistors electrically connected to a point intermediate said first diode and said second diode; and a bilateral symmetrical voltage sensitive switch connected across said second winding of said ballast reactor, said switch having two terminals one of which is connected intermediate said first capacitor and said second diode and the other of which is connected intermediate said second capacitor and said resistor means.

3. The starting apparatus of claim 2 wherein the bilateral symmetrical voltage sensitive switch is a sidac.

4. The starting apparatus of claim 2 further comprising a capacitor providing high frequency bypass connected across said input terminals.

* * * * *